US010337470B2

(12) United States Patent
Penzato

(10) Patent No.: US 10,337,470 B2
(45) Date of Patent: Jul. 2, 2019

(54) EXHAUST GAS RECIRCULATION APPARATUS

(71) Applicant: Ford Global Technologies, LLC, Dearborn, MI (US)

(72) Inventor: Sam Penzato, Bath (GB)

(73) Assignee: Ford Global Technologies, LLC, Dearborn, MI (US)

( * ) Notice: Subject to any disclaimer, the term of this patent is extended or adjusted under 35 U.S.C. 154(b) by 313 days.

(21) Appl. No.: 15/354,845

(22) Filed: Nov. 17, 2016

(65) Prior Publication Data

US 2017/0145967 A1 May 25, 2017

(30) Foreign Application Priority Data

Nov. 19, 2015 (GB) ..... 1520387.0

(51) Int. Cl.
*F02D 9/02* (2006.01)
*F02M 26/51* (2016.01)
(Continued)

(52) U.S. Cl.
CPC ..... *F02M 26/51* (2016.02); *F02D 9/02* (2013.01); *F02D 9/1035* (2013.01);
(Continued)

(58) Field of Classification Search
CPC ..... F02M 26/51; F02M 26/09; F02M 26/06; F02M 26/70; F02M 26/66; F02M 26/64;
(Continued)

(56) References Cited

U.S. PATENT DOCUMENTS 1,679,521 A * 8/1928 Good ..... F02M 69/00 123/179.21
4,171,689 A * 10/1979 Eheim ..... F02M 26/63 123/568.18
(Continued)

FOREIGN PATENT DOCUMENTS

DE 3237337 A1 * 4/1983 ..... F02D 21/08
DE 3237337 A1 4/1983
(Continued)

OTHER PUBLICATIONS

Examination Report of Great Britain Patent Application No. 1520387.0, dated May 20, 2016, 8 pages, United Kingdom Intellectual Property Office.

*Primary Examiner* — J. Todd Newton
(74) *Attorney, Agent, or Firm* — Julia Voutyras; McCoy Russell LLP

(57) ABSTRACT

The present disclosure describes an exhaust gas recirculation (EGR) apparatus for a turbocharged internal combustion engine, the EGR apparatus comprising: an air intake duct with a throttle valve configured to control an intake air quantity flowing through the air intake duct to a turbocharger compressor; an exhaust gas recirculation inlet connected to the air intake duct downstream of the throttle valve; and an EGR valve configured to control an exhaust gas quantity recirculated to the turbocharger compressor via the exhaust gas recirculation inlet, wherein the throttle valve and the EGR valve are combined in a single valve unit in which the valves are separated by a separating element configured to substantially prevent exhaust gas from entering the air intake duct in a vicinity of the throttle valve.

18 Claims, 3 Drawing Sheets

(51) Int. Cl.

| | |
|---|---|
| ***F02M 26/17*** | (2016.01) |
| ***F02M 26/21*** | (2016.01) |
| ***F02M 26/64*** | (2016.01) |
| ***F02M 26/66*** | (2016.01) |
| ***F02M 26/70*** | (2016.01) |
| ***F02M 26/06*** | (2016.01) |
| ***F02M 26/09*** | (2016.01) |
| ***F02D 9/10*** | (2006.01) |

(52) U.S. Cl.
CPC ..... *F02M 26/06* (2016.02); *F02M 26/09* (2016.02); *F02M 26/17* (2016.02); *F02M 26/21* (2016.02); *F02M 26/64* (2016.02); *F02M 26/66* (2016.02); *F02M 26/70* (2016.02); *F02D 2009/0276* (2013.01)

(58) Field of Classification Search
CPC ..... F02M 26/21; F02M 26/17; F02D 9/1035; F02D 9/02; F02D 2009/0276
USPC ..... 60/605.2
See application file for complete search history.

(56) References Cited

U.S. PATENT DOCUMENTS 4,237,837 A * 12/1980 Toda ..... F02M 26/55 123/568.18
4,280,470 A * 7/1981 Ueda ..... F02M 26/57 123/568.18
4,308,831 A * 1/1982 Sugasawa ..... F02D 17/02 123/198 F
4,329,965 A * 5/1982 Ueda ..... F02D 21/08 123/568.18
5,746,190 A * 5/1998 Honda ..... F02D 9/1065 123/568.18
6,244,255 B1 * 6/2001 Sagata ..... F02M 35/10052 123/568.11
6,907,868 B2 * 6/2005 Veinotte ..... F02D 9/103 123/568.18
6,928,994 B2 * 8/2005 Veinotte ..... F02M 26/21 123/568.18
6,948,483 B2 * 9/2005 Veinotte ..... F02M 35/10222 123/568.18
7,059,310 B2 * 6/2006 Altenschmidt ..... F02B 31/08 123/568.18
7,617,678 B2 11/2009 Joergl et al.
7,762,242 B2 * 7/2010 Gates ..... F02M 26/57 123/568.18
8,943,801 B2 2/2015 Peterson
2005/0188693 A1 * 9/2005 Schmid ..... F02B 37/22 60/599
2007/0261683 A1 * 11/2007 Weiss ..... F02B 29/04 123/568.17
2016/0153378 A1 * 6/2016 Han ..... F02D 41/005 123/568.21
2016/0281651 A1 * 9/2016 Hashimoto ..... F02M 26/41

FOREIGN PATENT DOCUMENTS

| | | | |
|---|---|---|---|
| EP | 0363021 | A1 | 9/1989 |
| EP | 3012445 | A1 | 4/2016 |
| FR | 2845732 | A1 | 4/2004 |
| GB | 2313208 | A | 11/1997 |
| JP | S5459521 | A | 5/1979 |
| JP | H10213019 | A | 8/1998 |
| JP | 2010065531 | A | 3/2010 |
| WO | 2006092401 | A1 | 9/2006 |
| WO | 2007089771 | A2 | 8/2007 |
| WO | 2007098133 | A1 | 8/2007 |

* cited by examiner

EXHAUST GAS RECIRCULATION APPARATUS

CROSS REFERENCE TO RELATED APPLICATION

The present application claims priority to Great Britain Patent Application No. 1520387.0, filed on Nov. 19, 2015. The entire contents of the above-referenced application are hereby incorporated by reference in its entirety for all purposes.

FIELD

The present disclosure relates to an exhaust gas recirculation (EGR) apparatus, and in particular to a low-pressure EGR apparatus.

BACKGROUND/SUMMARY

Fuel efficiency and exhaust pollutant levels are viewed as increasingly important characteristics for all vehicles. This has led to a very high proportion of vehicle engines being fitted with turbochargers which often incorporate an exhaust gas recirculation system. Exhaust gas recirculation (EGR) is a process used to improve engine efficiency and reduce the presence of NOx compounds in the emitted exhaust gases by recirculating a portion of the exhaust gases through the engine. In low-pressure EGR, the EGR gases are introduced upstream of the turbocharger compressor inlet. The pressure at this location is low, even in high engine boost conditions, which allows for the low pressure recirculation of the exhaust gases.

In low-pressure EGR systems, EGR gases introduced upstream of the turbocharger compressor are mixed with engine inlet air before entering the turbocharger compressor inlet. The amount of EGR gases which can be introduced may determine the extent to which engine efficiency and exhaust gas pollutant levels are improved. However, the level of recirculation possible is often limited by condensation of water droplets in the exhaust gases. As the exhaust gases are mixed with the cooler inlet air, water vapor begins to condense from the exhaust gases. This effect may be exacerbated in cold ambient conditions. Contact between the EGR gases and the walls of the duct upstream of the turbocharger compressor also contributes to the condensation. Water droplets can be undesirable at the inlet of the compressor, especially when large water droplets are formed, which may damage the compressor blades. Thus, it is desirable for the EGR gases to be introduced close to the compressor face. However, in EGR implementations where the EGR gases are introduced close to the compressor face and at the same point at which the throttling function is performed then unstable turbulent air can reduce the compressor's operational efficiency.

According to an aspect of the present disclosure, there is provided an exhaust gas recirculation (EGR) apparatus for a turbocharged internal combustion engine, the EGR apparatus comprising: an air intake duct with a throttle valve configured to control an intake air quantity flowing through the air intake duct to a turbocharger compressor; an exhaust gas recirculation inlet connected to the air intake duct downstream of the throttle valve; and an EGR valve configured to control an exhaust gas quantity recirculated to the turbocharger compressor via the exhaust gas recirculation inlet, wherein the throttle valve and the EGR valve are combined in a single valve unit in which the valves are separated by a separating element configured to substantially prevent exhaust gas from entering the air intake duct in a vicinity of the throttle valve.

Introducing recirculated exhaust gas to the air intake duct closer to the compressor face can reduce the risk of condensate droplets propagating into the air intake duct and damaging the turbocharger compressor, while positioning the throttle valve further from the compressor face gives the throttled air distance to re-stabilize before entering the turbocharger compressor. This more stable flow is desired for optimal turbocharger compressor performance. Combining the valves in a single valve unit, in which the valves can operated simultaneously, so that the air intake duct can be closed and at the same time the exhaust gas recirculation inlet can be opened (or the air intake duct opened and the exhaust gas recirculation inlet closed), for example by means of a common actuator, can realize savings in weight, complexity and cost compared to separate throttle valve and EGR valve units having dedicated actuators for example.

The valve unit can have a main valve body defining a passage through which exhaust gas flows to the exhaust gas recirculation inlet when a movable valve element of the EGR valve is in an open position, and the separating element can be disposed between the passage of the valve body and the throttle valve. This provides a simple configuration for fluidly separating the air flow in the vicinity of the throttle valve from the recirculated exhaust gas. The main valve body can be directly attached to the air intake duct.

The movable valve element of the EGR valve can be mechanically connected to a movable valve element of the throttle valve by a valve stem which passes through a gap in the separating element. However, the throttle valve can be mechanically connected to the EGR valve by any kind of linkage, gears, or other mechanism configured to allow the valves to operate in unison.

The exhaust gas recirculation inlet can comprise a conduit which fluidly connects the passage of the valve body to the interior of the air intake duct downstream of the throttle valve. This provides a simple construction by which the exhaust gas can be introduced to the air intake duct downstream of the throttle valve. The distance between the throttle valve and the point of introduction of the exhaust gas into the air intake duct, the distance between the throttle valve and the turbocharger compressor, and/or the distance between the point of introduction of the exhaust gas into the air intake duct and the turbocharger, can be varied depending on engine application and EGR usage schedules. Furthermore, installation factors and limitations such as duct size and shape can affect the positioning. The conduit can have an opening on the air intake duct. Alternatively, the conduit may extend into the air intake duct. For example, the conduit can include an end portion that extends upwardly into the air intake duct. The end portion can be curved so as to direct exhaust gas towards the turbocharger compressor. Other configurations are also possible. For example, the end portion may comprise an initial straight portion extending into the air intake duct, followed by a bend section that curves towards the turbocharger compressor, followed by a further straight section. The outlet of the end portion can be positioned centrally with respect to the air intake duct outlet.

The separating element can comprises a plate, which can be can formed as an integral cast part of the EGR apparatus or, alternatively, as a component which is inserted between the passage and the throttle valve, for example during assembly of the EGR apparatus.

The throttle valve can comprise a throttle flap. The EGR valve can comprise a lifting valve such as a poppet valve.

According to another aspect of the disclosure, there is provided an engine system, comprising: an internal combustion engine having an intake manifold and an exhaust manifold; a turbocharger mounted on the engine, the turbocharger including a turbine fluidly connected to the exhaust manifold and a compressor fluidly connected to the intake manifold; and the aforementioned exhaust gas recirculation (EGR) apparatus.

According to another aspect of the disclosure, there is provided a motor vehicle including the aforementioned engine system.

According to another aspect of the disclosure, there is provided an exhaust gas recirculation (EGR) method for an internal combustion engine with a turbocharger, the EGR method comprising: controlling, by the throttle valve, an intake air quantity flowing through an air intake duct provided with the throttle valve to a compressor of the turbocharger; and controlling, by the EGR valve which is combined with the throttle valve as a single valve unit, an exhaust gas quantity recirculated to the compressor via an exhaust gas recirculation inlet connected to the air intake duct downstream of the throttle valve; and substantially preventing, by a barrier which separates the throttle valve from the EGR valve, exhaust gas from entering the air intake duct at the throttle valve.

Additional aspects and/or advantages will be set forth in part in the description which follows and, in part, will be apparent from the description, or may be learned by practice of example embodiments of the present application.

BRIEF DESCRIPTION OF THE DRAWINGS

Reference will be made, by way of example, to the accompanying drawings, wherein like reference numerals refer to the like elements throughout and in which.

DETAILED DESCRIPTION

For a better understanding of the present disclosure, a brief overview of low-pressure exhaust gas recirculation (EGR) systems will be given first. In low-pressure EGR systems, exhaust gas generated by an engine exits through an exhaust manifold and passes through a turbocharger turbine which powers a turbocharger compressor. The exhaust gas then flows either into an exhaust pipe, from which the exhaust gas leaves the vehicle, or into an EGR loop. In the low-pressure EGR loop, the exhaust gas passes through a low pressure EGR cooler, which cools the temperature of the exhaust gas, subsequent to which it passes through an EGR valve and then is mixed with air in an air intake duct. The mixture of air and exhaust gas is then introduced to the turbocharger compressor which pressurizes the mixed intake gas. The high-pressure mixture is then passed through a charge air cooler into an intake manifold of the engine.

Figure 1:
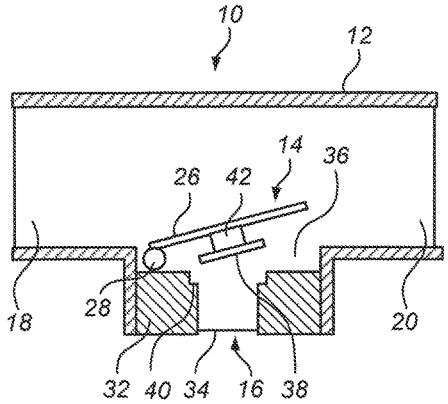
FIG. 1 is a cross-sectional schematic diagram of a low-pressure EGR apparatus.

FIG. 1 is a schematic diagram of an EGR apparatus 10 which can be implemented as part of a low pressure EGR system. The EGR apparatus 10 comprises a throttle valve 14 and an EGR valve 16 that are combined together as a single valve unit, referred to herein as a "combination valve" (or "combi-valve" for short), in which the amount of intake air supplied to the turbocharger compressor and the amount of exhaust gas recirculated to the turbocharger compressor is simultaneously controlled.

In particular, the throttle valve 14 is arranged between an inlet 18 and an outlet 20 of an air intake duct 12, and controls the amount of intake air supplied to the turbocharger by opening or closing the air intake duct 12. The air intake duct 12 directs intake air toward the turbocharger compressor (not depicted in FIG. 1), and can be of circular or some other cross section. The throttle valve 14 can be any suitable valve for controlling the flow of intake air through the air intake duct 12, though in this example the throttle valve 14 comprises a throttle flap (throttle plate) 26 mounted on a hinge 28. The hinge 28 serves as an actuator which changes the position of the throttle flap 26 between open and closed positions. However, any type of controlling mechanism such as a solenoid, pneumatic, hydraulic actuator or other type of mechanism can be provided.

The EGR valve 16 is arranged in an EGR path, and controls the amount of exhaust gas recirculated to the turbocharger by opening or closing the EGR path. In particular, the EGR valve allows a flow of exhaust gas to the air intake duct 12 when in an open position, and blocks the flow of exhaust gas to the air intake duct 12 when in a closed position. In more detail, the EGR valve 16 comprises a valve head 38 and a valve seat 40, which is an aperture positioned in a path of exhaust gas flow between an inlet port 34 and an outlet port 36 of a main body 32 of the combination valve. The valve head 38 is movable between the closed position where the valve head 38 is seated on (brought into contact with), and seals, the valve seat 40, and the open position where the valve head 38 is lifted away from the valve seat 40. Thus, in this particular example, the EGR valve 16 is a lifting valve such as a poppet valve. However, the EGR valve 16 can be any suitable valve for controlling the flow of exhaust gas.

The valve head 38 of the EGR valve 16 is connected to the throttle flap 26 by a valve stem 42. In this way, the combination valve can simultaneously control the flow of intake air through the air intake duct 12 and the flow of exhaust gas recirculated to the air intake duct 12, that is simultaneously close the air intake duct 12 and open the exhaust gas path (or open the air intake duct 12 and close the exhaust gas path), by means of a single actuator, i.e., the hinge 28.

Figure 2:
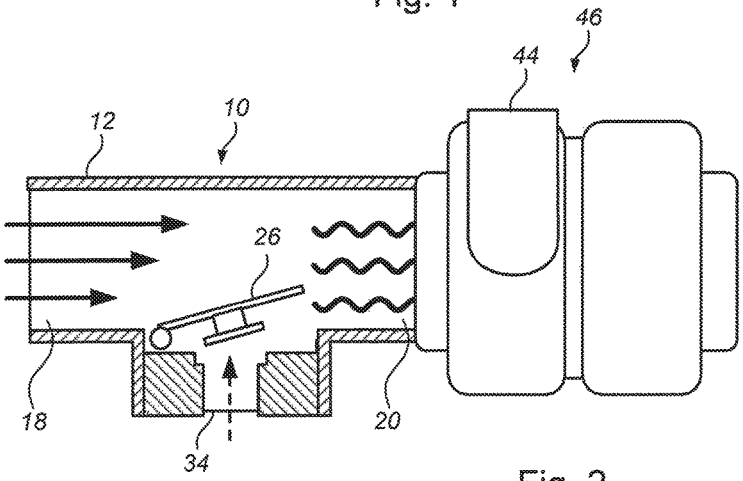
FIG. 2 is a cross-sectional schematic diagram of a 'close-coupled' low-pressure EGR apparatus.
Figure 3:
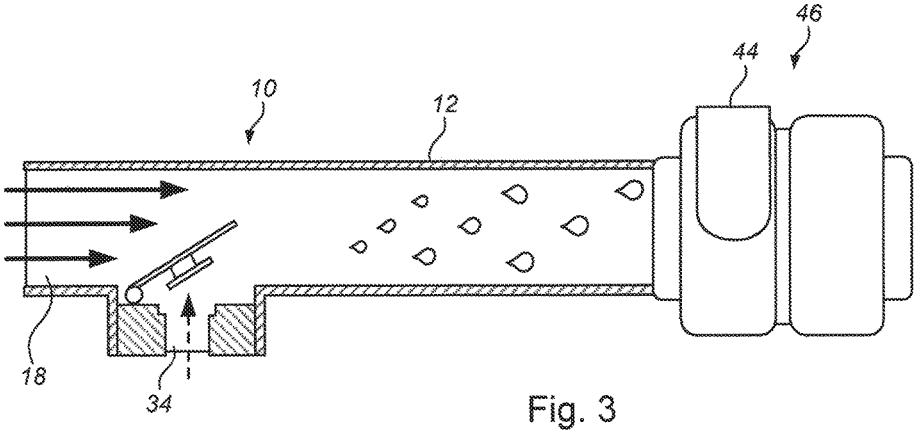
FIG. 3 is a cross-sectional schematic diagram of a 'detached' low-pressure EGR apparatus.

The EGR apparatus 10 shown in FIG. 1 has the disadvantage that the exhaust gas entry location is the same as the throttle valve location. As noted previously, on the one hand it is desirable for the EGR gases to be introduced close to the compressor face, but on the other hand it is also desirable for the throttle to be placed at a distance from the compressor face. In a close-coupled combination valve, as shown in FIG. 2, the throttle flap causes major disturbances to the oncoming clean air (shown in FIG. 2 as wavy lines and large arrow, respectively). This unstable, turbulent air directly in front of the compressor (i.e., the compressor wheel) reduces the operational efficiency of the compressor. A uniform and stable flow is desired for optimum compressor performance. On the other hand, in a detached combination valve, as shown in FIG. 3, the combination valve is moved further back from the compressor. However, this increases the risk of damage to the compressor wheel from condensate formation. Specifically, when hot EGR gasses from the exhaust gas inlet meet cold inlet gases from the fresh air inlet, condensate is formed at the mixing point/zone. A longer duct provides a greater distance in which the initial mist can coalesce into larger water droplets (shown in FIG. 3 as drops). These large water droplets significantly reduce the life of the compressor wheel and will eventually lead to compressor failure. Accordingly, a compromise must be made when choosing the distance from the combination valve from the turbocharger compressor. The issues outlined above can be resolved by using separate throttle and EGR valves. However, this would negate the weight, complexity and cost benefits of the combined throttle/EGR valve.

Figure 4:
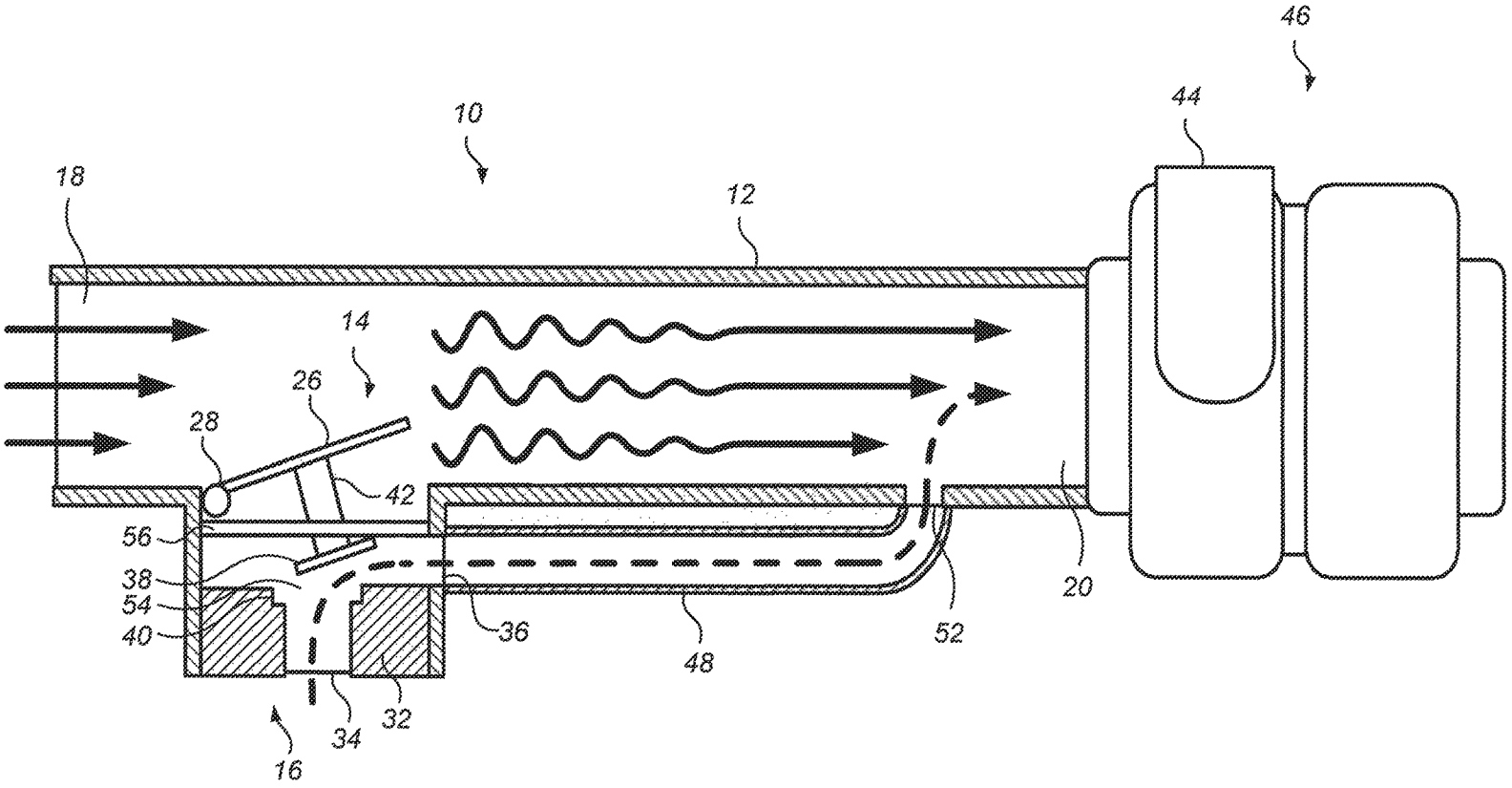
FIG. 4 is a cross-sectional schematic diagram of a low-pressure EGR apparatus according to the present disclosure.
Figure 5:
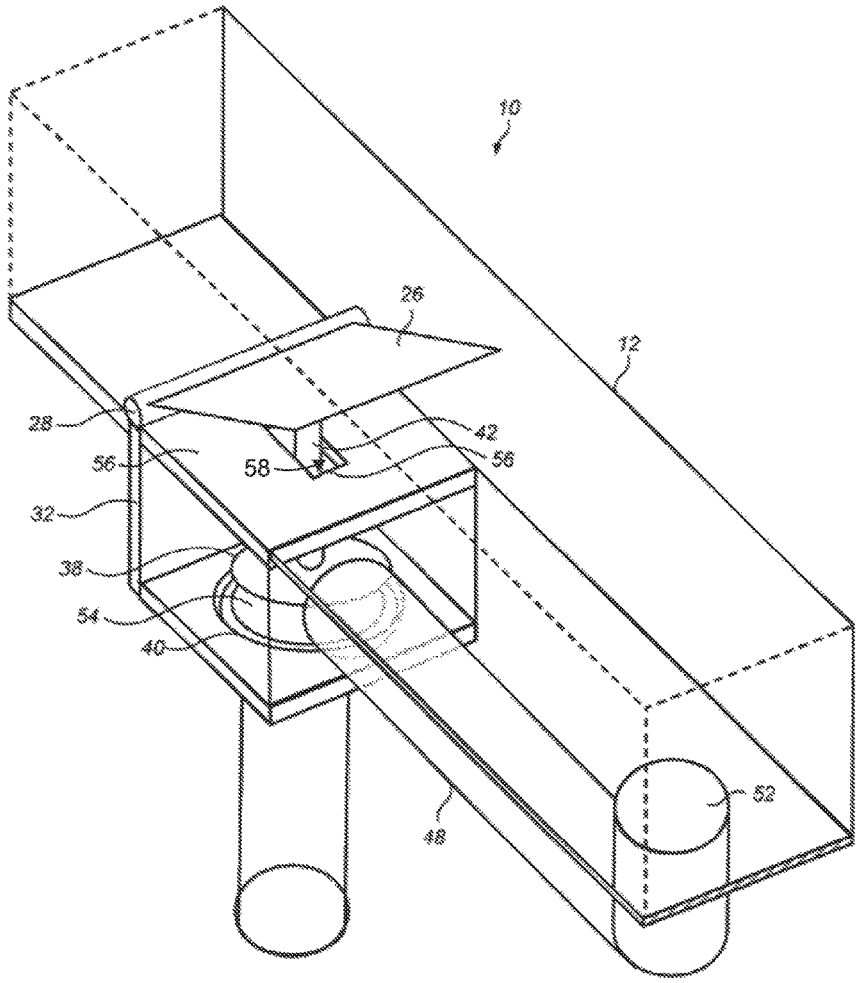
FIG. 5 is perspective schematic diagram of the low-pressure EGR apparatus of FIG. 4.

FIGS. 4 and 5 are schematic diagrams of an EGR apparatus in which the exhaust gas entry point to the air intake duct is separated from the main body of the combination valve. Similar to the EGR apparatus 10 depicted in FIG. 1, the EGR apparatus 10 depicted in FIGS. 4 and 5 comprises a throttle valve 14 and an EGR valve 16. As before, the throttle valve 14 comprises a pivotable element 26 (throttle flap) driven by an actuator 28, and the EGR valve 16 comprises a valve head 38 and a valve seat 40 formed such that an exhaust gas flow path (indicated by the dashed line) is created for exhaust gas to flow through when the valve head 38 is in an open position. However, in contrast to the EGR apparatuses depicted in FIGS. 1 to 3, the outlet port 36 of the valve body 32 is fluidly connected to an exhaust gas recirculation inlet 48 that is connected to the air intake duct 12 downstream of the throttle valve 14. In particular, the exhaust gas recirculation inlet 48 comprises a conduit extending from the outlet port 36 of the valve body 32 to an opening 52 into the air intake duct 12. The exhaust gas recirculation inlet may have any size, shape or configuration suitable for directing exhaust gas to the air intake duct 12. The EGR valve 14 is separated from the throttle valve 14 by a plate 56 which is configured to substantially prevent exhaust gas from entering the interior of the air intake duct in a vicinity of the throttle valve 14. Thus, when the EGR valve 16 is in the open position (as depicted in FIGS. 4 and 5), recirculated exhaust gas passes from the inlet port 34 of the valve body 32, in which the movable valve element 38 of the EGR valve 16 is disposed, to the outlet port 36 of the valve body 32. From there, the recirculated exhaust gas enters the conduit and flows to the opening 52 of the air intake duct 12. To allow the throttle valve 14 and EGR valve 16 to operate in unison, the plate 56 includes a slot 58 through which the valve stem 42 extends. Advantageously, the EGR apparatus depicted in FIGS. 4 and 5 retains the combined nature of the throttle and EGR valves, while providing a separate path for the recirculated exhaust gas. FIGS. 2-4 also show a turbocharger 46 having a compressor 44.

FIGS. 1-5 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

It will be appreciated by those skilled in the art that although the invention has been described by way of example, with reference to one or more examples, it is not limited to the disclosed examples and that alternative examples could be constructed without departing from the scope of the invention as defined by the appended claims.

The subject matter claimed herein is not limited to embodiments that solve any disadvantages or that operate only in environments such as those described above. Rather, these are only provided to illustrate example technology areas where some embodiments described herein may be practiced.

All examples and conditional language recited herein are intended to aid the reader in understanding the invention and the concepts contributed by the inventor to furthering the art, and are to be construed as being without limitation to such specifically recited examples and conditions. Although embodiments have been described in detail, it should be understood that the various changes, substitutions, and alterations could be made without departing from the spirit and scope of the disclosure.

The invention claimed is:

1. An exhaust gas recirculation (EGR) apparatus for a turbocharged internal combustion engine, the EGR apparatus comprising:

an air intake duct with a throttle valve configured to control an intake air quantity flowing through the air intake duct to a turbocharger compressor;

an exhaust gas recirculation inlet connected to the air intake duct downstream of the throttle valve; and an EGR valve configured to control an exhaust gas quantity recirculated to the turbocharger compressor via the exhaust gas recirculation inlet;

wherein the throttle valve and the EGR valve are combined in a single valve unit in which the EGR valve and the throttle valve are separated by a separating element configured to substantially prevent exhaust gas from entering the air intake duct in a vicinity of the throttle valve;

wherein the single valve unit has a main valve body defining a passage through which exhaust gas flows to the exhaust gas recirculation inlet when a movable valve element of the EGR valve is in an open position, and the separating element is disposed between the passage of the main valve body and the throttle valve; and wherein the separating element comprises a plate formed as a component which is inserted between the passage and the throttle valve.

2. The EGR apparatus according to claim 1, wherein the movable valve element of the EGR valve is mechanically connected to a movable valve element of the throttle valve by a valve stem which passes through a gap in the separating element.

3. The EGR apparatus according to claim 2, wherein the exhaust gas recirculation inlet comprises a conduit which fluidly connects the passage of the main valve body to an interior of the air intake duct downstream of the throttle valve.

4. The EGR apparatus according to claim 1, wherein the exhaust gas recirculation inlet comprises a conduit which fluidly connects the passage of the main valve body to an interior of the air intake duct downstream of the throttle valve.

5. The EGR apparatus according to claim 4, wherein the separating element comprises the plate formed as an integral cast part of the EGR apparatus.

6. The EGR apparatus according to claim 4, wherein the separating element comprises a slot and where a valve stem coupled to a throttle plate in the throttle valve extends through the slot.

7. The EGR apparatus according to claim 4, wherein the EGR valve comprises a poppet valve.

8. The EGR apparatus according to claim 1, wherein the separating element comprises the plate formed as an integral cast part of the EGR apparatus.

9. The EGR apparatus according to claim 1, wherein the throttle valve comprises a throttle flap.

10. The EGR apparatus according to claim 1, wherein the EGR valve comprises a poppet valve.

11. The EGR apparatus according to claim 1, wherein the throttle valve includes a throttle flap mounted on a hinge.

12. An exhaust gas recirculation (EGR) method for a turbocharged internal combustion engine, the EGR method comprising:

controlling, by a throttle valve, an intake air quantity flowing through an air intake duct provided with the throttle valve to a turbocharger compressor; and controlling, by an EGR valve which is combined with the throttle valve in a single valve unit in which the EGR valve and the throttle valve are separated by a separating element configured to substantially prevent exhaust gas from entering the air intake duct in a vicinity of the throttle valve, an exhaust gas quantity recirculated to the turbocharger compressor via an exhaust gas recirculation inlet connected to the air intake duct downstream of the throttle valve;

wherein the valve unit has a main valve body defining a passage through which exhaust gas flows to the exhaust gas recirculation inlet when a movable valve element of the EGR valve is in an open position, and the separating element is disposed between the passage of the main valve body and the throttle valve; and wherein the separating element comprises a plate formed as a component which is inserted between the passage and the throttle valve.

13. The EGR method of claim 12, wherein the movable valve element of the EGR valve is mechanically connected to a movable valve element of the throttle valve by a valve stem which passes through a gap in the separating element.

14. The EGR method of claim 12, wherein the exhaust gas recirculation inlet comprises a conduit which fluidly connects the passage of the main valve body to an interior of the air intake duct downstream of the throttle valve.

15. The EGR method of claim 12, wherein the throttle valve comprises a throttle flap and wherein the EGR valve comprises a poppet valve.

16. An exhaust gas recirculation (EGR) system, comprising:

an air intake duct upstream of a compressor;

an EGR inlet fluidly connected to the air intake duct;

a valve unit including:

a throttle plate positioned in the air intake duct configured to control an intake air quantity flowing through the air intake duct to the compressor;

a valve head coupled to the throttle plate via a valve stem and moveable into an open position where exhaust gas is permitted to flow to the EGR inlet through a passage of the valve unit; and a separating plate positioned between the passage and the throttle plate and configured to substantially prevent exhaust gas from entering the air intake duct adjacent to the throttle valve.

17. The EGR system of claim 16, wherein the separating plate includes a slot and wherein the valve stem extends through the slot.

18. The EGR system of claim 16, wherein the EGR inlet comprises a conduit extending from an outlet port of a valve unit valve body to an opening in the air intake duct downstream of the throttle plate.

* * * * *